US006022199A

United States Patent [19]

Yoshii et al.

[11] Patent Number: 6,022,199

[45] Date of Patent: Feb. 8, 2000

[54] RECIPROCATING COMPRESSOR

[75] Inventors: Kiyoshi Yoshii; Katsutoshi Enomoto, both of Higashimatsuyama; Katsuhiko Arai, Tokyo; Hisao Ichikawa, Hiroshima, all of Japan

[73] Assignee: Zexel Corporation, Tokyo, Japan

[21] Appl. No.: 09/063,250

[22] Filed: Apr. 20, 1998

[30] Foreign Application Priority Data

Apr. 22, 1997 [JP] Japan ..... 9-118854

[51] Int. Cl.[7] ..... F04B 1/12

[52] U.S. Cl. ..... 417/269; 417/560; 137/512.4

[58] Field of Search ..... 417/269, 560, 417/571; 137/512.4

[56] References Cited

U.S. PATENT DOCUMENTS

| | | | |
|---|---|---|---|
| 5,477,773 | 12/1995 | Murakami et al. | 92/71 |
| 5,483,867 | 1/1996 | Ikeda et al. | 92/71 |
| 5,709,535 | 1/1998 | Enomoto et al. . | |
| 5,878,649 | 3/1999 | Raab | 92/12.2 |

FOREIGN PATENT DOCUMENTS 9-4563 1/1997 Japan .

*Primary Examiner*—John A. Jeffery
*Assistant Examiner*—Vinod D Patel
*Attorney, Agent, or Firm*—Frishauf, Holtz, Goodman, Langer & Chick, P.C.

[57] ABSTRACT

A reciprocating compressor is provided. Compression chambers are formed on at least one end of pistons slidably received within respective cylinder bores of a cylinder block. A cylinder head is secured to the cylinder block and has a high-pressure chamber and a low-pressure chamber formed therein. A separating member is arranged between the cylinder block and the cylinder head. The separating member has a valve sheet, a valve plate, a stopper plate. The valve sheet is formed with suction valves and discharge valves. The valve plate is arranged between the valve sheet and the cylinder block, and formed with refrigerant outlet ports and relief holes each opening into a corresponding one of the compression chambers, for communicating with a corresponding one of refrigerant inlet ports formed through the stopper plate when the corresponding suction valve opens. The relief holes and/or refrigerant outlet ports each have a projecting portion formed integrally with a portion of a rim of an opening thereof in a manner bent in a direction of thickness of the valve plate. The stopper plate is arranged between the valve sheet and the cylinder head and formed with the refrigerant inlet ports, refrigerant outlet passages each opening into the high-pressure chamber for communicating with a corresponding one of the refrigerant outlet ports when a corresponding one of the discharge valves opens, and stoppers each setting a limit to an amount of opening of a corresponding one of the discharge valves.

11 Claims, 10 Drawing Sheets

RECIPROCATING COMPRESSOR

BACKGROUND OF THE INVENTION

1. Field of the Invention

This invention relates to a reciprocating compressor, such as a swash plate compressor, a wobble plate compressor, and an in-line compressor (crank compressor).

2. Description of the Prior Art

The present assignee proposed a reciprocating compressor (swash plate compressor) in Japanese Laid-Open Patent Publication (Kokai) No. 9-4563 (corresponding to U.S. Pat. No. 5,709,535).

The proposed swash plate compressor includes a cylinder block having a plurality of compression chambers formed therein, a cylinder head which is secured to the cylinder block and has a discharge chamber and a suction chamber formed therein, a valve plate arranged between the cylinder block and the cylinder head for separating the compression chambers from the discharge chamber and the suction chamber, refrigerant outlet ports via which refrigerant gas is delivered from the compression chambers to the discharge chamber, refrigerant inlet ports via which refrigerant gas is drawn from the suction chamber into the compression chambers, discharge valve:; for opening and closing the refrigerant outlet ports, suction valves for opening and closing the refrigerant inlet ports, and stoppers for each setting a proper limit to an amount of opening or resilient deformation of a corresponding one of the discharge valves.

FIG. 1 shows a valve plate, a valve sheet, and a stopper plate of another conventional reciprocating compressor (swash plate compressor) of this type, in an exploded state, which is proposed by the present assignee in Japanese Patent Application No. 9-14665, while FIG. 2 is a plan view of the stopper plate of the proposed compressor in a state in which the valve plate, the valve sheet, and the stopper plate are assembled. FIG. 3 is a partially sectional view taken on line III—III of FIG. 2.

In the proposed reciprocating compressor, the discharge valves are formed by the valve sheet 327 and a plurality of discharge valve elements 327*a* integrally provided thereon, while the suction valves are formed by the same valve sheet 327 and a plurality of suction valve elements 327*d* integrally provided thereon. The discharge valve elements 327*a* and the suction valve elements 327*d* are each provided by cutting a portion of the valve sheet 327 into a tongue shape.

The stoppers are formed by the stopper plate 329 arranged between the valve sheet 327 and the cylinder head 304, and a plurality of stopper portions 329*a* which are each formed by cutting a portion of the stopper plate 329 opposed to a corresponding one of the discharge valve elements 327*a*. The stopper plate 329 is also formed therethrough with the refrigerant inlet ports 329*d* as well as a plurality of slots 329*b* each open to the discharge chamber 324 for communicating between the discharge chamber 324 and a corresponding one of the refrigerant outlet ports 303*a*.

The valve plate 303 is formed with the refrigerant outlet ports 303*a* as well as a plurality of relief holes 303*b* each open to a corresponding one of the compression chambers 321 for communicating between the compression chamber 321 and a corresponding one of the refrigerant inlet ports 329*d*.

Since, as described above, the proposed compressor employs the valve sheet 327 formed with the plurality of discharge valve elements 327*a* and suction valve elements 327*d* as well as the stopper plate 329 formed with the plurality of stopper portions 329*a*, component parts are reduced in number, and moreover, the valve plate 303, the valve sheet 327, and the stopper plate 329 can be simply placed on the cylinder block, one upon another, when they are assembled to the cylinder block, which markedly facilitates assembly of the compressor.

A problem with the compressor is that the valve plate 303 is deformed or distorted toward the compression chamber 321 during each suction stroke due to a difference in pressure between the discharge chamber 324 and the compression chamber 321, and if the amount of deformation of the valve plate 303 becomes large, high-pressure refrigerant gas delivered to the discharge chamber 324 flows back to the compression chamber 321, which results in degraded performance of the compressor.

A solution to the problem of the back flow of refrigerant gas is to increase the thickness of the valve plate 303 so as to increase the rigidity of the valve plate 303.

However, if the thickness of the valve plate 303 is increased, volumes of the refrigerant outlet ports 303*a* and the relief holes 303*b* become larger to increase dead volume, causing degradation of volumetric efficiency of the compressor.

SUMMARY OF THE INVENTION

It is an object of the invention to provide a reciprocating compressor which is capable of preventing a back flow of refrigerant gas from a high-pressure chamber to compression chambers without increasing the thickness of a valve plate thereof.

To attain the above object, according to a first embodiment of the present invention, there is provided a reciprocating compressor including a cylinder block having a plurality of compression chambers formed therein, the compression chambers being formed on at least one of opposite ends of respective pistons slidably received within respective cylinder bores, a cylinder head secured to the cylinder block and having a high-pressure chamber and a low-pressure chamber formed therein, and a separating member arranged between the cylinder block and the cylinder head, the separating member having a plurality of refrigerant inlet ports for suctioning a refrigerant gas from the low-pressure chamber into the compression chambers, a plurality of refrigerant outlet ports for discharging the refrigerant gas from the compression chambers into the high-pressure chamber, a plurality of suction valves for opening and closing the refrigerant inlet ports, respectively, and a plurality of discharge valves for opening and closing the refrigerant outlet ports, respectively.

The reciprocating compressor according to the first aspect of the invention is characterized in that the separating member comprises:

- a valve sheet formed with the suction valves and the discharge valves;
- a valve plate arranged between the valve sheet and the cylinder block, and formed with the refrigerant outlet ports and a plurality of relief holes each opening into a corresponding one of the compression chambers, for communicating with a corresponding one of the refrigerant inlet ports when a corresponding one of the suction valves opens, the relief holes each having a projecting portion formed integrally with a portion of a rim of an opening thereof in a manner bent in a direction of thickness of the valve plate; and
- a stopper plate arranged between the valve sheet and the cylinder head and formed with the refrigerant inlet ports, a plurality of refrigerant outlet passages each opening into the high-pressure chamber, for communicating with a corresponding one of the refrigerant outlet ports when a corresponding one of the discharge valves opens, and a plurality of stoppers each setting a limit to an amount of opening of a corresponding one of the discharge valves.

According to this reciprocating compressor, the relief holes each have a projecting portion formed integrally with a portion of the rim of the opening thereof in a manner bent in the direction of thickness of the valve plate. Therefore, it is possible to increase the rigidity of the valve plate without increasing thickness of the same, to thereby prevent deformation of the valve plate due to a difference in pressure between the high-pressure chamber and the compression chambers and a resultant back flow of high-pressure refrigerant gas from the high-pressure chamber into the compression chambers.

Preferably, the projecting portion is bent toward a partition wall of the cylinder head that separates the high-pressure chamber and the low-pressure chamber from each other, and received in a through hole formed through the valve sheet and a space formed in the stopper plate in a manner continuing from the through hole.

According to this preferred embodiment, the projecting portion is bent toward the partition wall of the cylinder head which separates the high-pressure chamber and the low-pressure chamber from each other, and received in the through hole formed through the valve sheet and the space formed in the stopper plate. Therefore, it is possible to increase the rigidity of the valve plate without increasing thickness of the same, to thereby prevent deformation of the valve plate due to a difference in pressure between the high-pressure chamber and the low-pressure chamber and a resultant back flow of high-pressure refrigerant gas from the high-pressure chamber to the compression chambers.

More preferably, the space comprises a through hole formed through the stopper plate, and the separating member further includes a gasket arranged between the stopper plate and the partition wall of the cylinder head for sealing the through hole of the stopper plate.

Alternatively, the through hole of the stopper plate is defined by an inner peripheral wall formed with a recess, and the projecting portion has an end thereof bent at a right angle with respect to the direction of thickness of the valve plate and fitted in the recess.

According to this preferred embodiment, the end of the projecting portion is bent at a right angle with respect to the direction of thickness of the valve plate and fitted in the recess in the peripheral wall defining the through hole to thereby connect the valve plate and the stopper plate to each other, whereby the valve plate is inhibited from moving in the direction of thickness thereof, so that deformation or distortion of the plate can be prevented more reliably. Moreover, the valve plate, the valve sheet, and the stopper plate are connected to each other to form a unit, which facilitates assembly of the compressor.

Preferably, the space comprises a recess formed in the stopper plate, and the projecting portion has an end thereof fitted in the recess.

According to this preferred embodiment, since the end of the projecting portion is fitted in the recess, the valve plate is inhibited from moving in a radial direction, whereby deformation of the valve plate due to a difference in pressure between the high-pressure chamber and the low-pressure chamber is prevented. Further, the stopper plate has no holes formed therethrough for forming the spaces, so that the back flow of high-pressure refrigerant gas into the low-pressure chamber can be prevented.

Preferably, the valve plate further includes a projecting portion formed integrally with a portion of a rim of an opening of each of the refrigerant outlet ports in a manner bent in the direction of thickness of the valve plate.

According to this preferred embodiment, since the valve plate is formed with two kinds of projecting portions, the rigidity of the valve plate is further increased, which makes it possible to more reliably prevent the valve plate from being deformed or distorted due to a difference in pressure between the high-pressure chamber and the compression chamber.

Preferably, the discharge valves each comprise a tongue shaped portion cut from the valve sheet, the suction valves each comprising a tongue shaped portion cut from the valve sheet, the stoppers comprising a bottom of each of grooves formed in the stopper plate, the refrigerant outlet passages communicating with the grooves, respectively.

To attain the above object, according to a second aspect of the invention, there is provided a reciprocating compressor which is characterized in that the separating member comprises:

a valve sheet formed with the suction valves and the discharge valves;

a valve plate arranged between the valve sheet and the cylinder block, and formed with the refrigerant outlet ports and a plurality of relief holes each opening into a corresponding one of the compression chambers, for communicating with a corresponding one of the refrigerant inlet ports when a corresponding one of the suction valves opens, the refrigerant outlet ports each having a projecting portion formed integrally with a portion of a rim of an opening thereof in a manner bent in a direction of thickness of the valve plate; and a stopper plate arranged between the valve sheet and the cylinder head and formed with the refrigerant inlet ports, a plurality of refrigerant outlet passages each opening into the high-pressure chamber for communicating with a corresponding one of the refrigerant outlet ports when a corresponding one of the discharge valves opens, and a plurality of stoppers each setting a limit to an amount of opening of a corresponding one of the discharge valves.

According to this reciprocating compressor, since the projecting portion formed integrally with the rim of the opening of each refrigerant outlet port is bent or protruded in the direction of thickness of the valve plate, it is possible to increase the rigidity of the valve plate without increasing thickness of the same, to thereby prevent deformation of the valve plate due to a difference in pressure between the high-pressure chamber and the compression chamber and a resultant back flow of high-pressure refrigerant gas from the high-pressure chamber to the compression chambers.

Preferably, the projecting portion is bent toward a partition wall of the cylinder head that separates the high-pressure chamber and the low-pressure chamber from each other, and received in a through hole formed through the valve sheet and a space formed in the stopper plate in a manner continuing from the through hole.

The above and other objects, features and advantages of the present invention will become more apparent from the following detailed description taken in conjunction with accompanying drawings.

DETAILED DESCRIPTION OF THE PREFERRED EMBODIMENTS

The invention will now be described in detail with reference to drawings showing preferred embodiments thereof.

Figure 5:
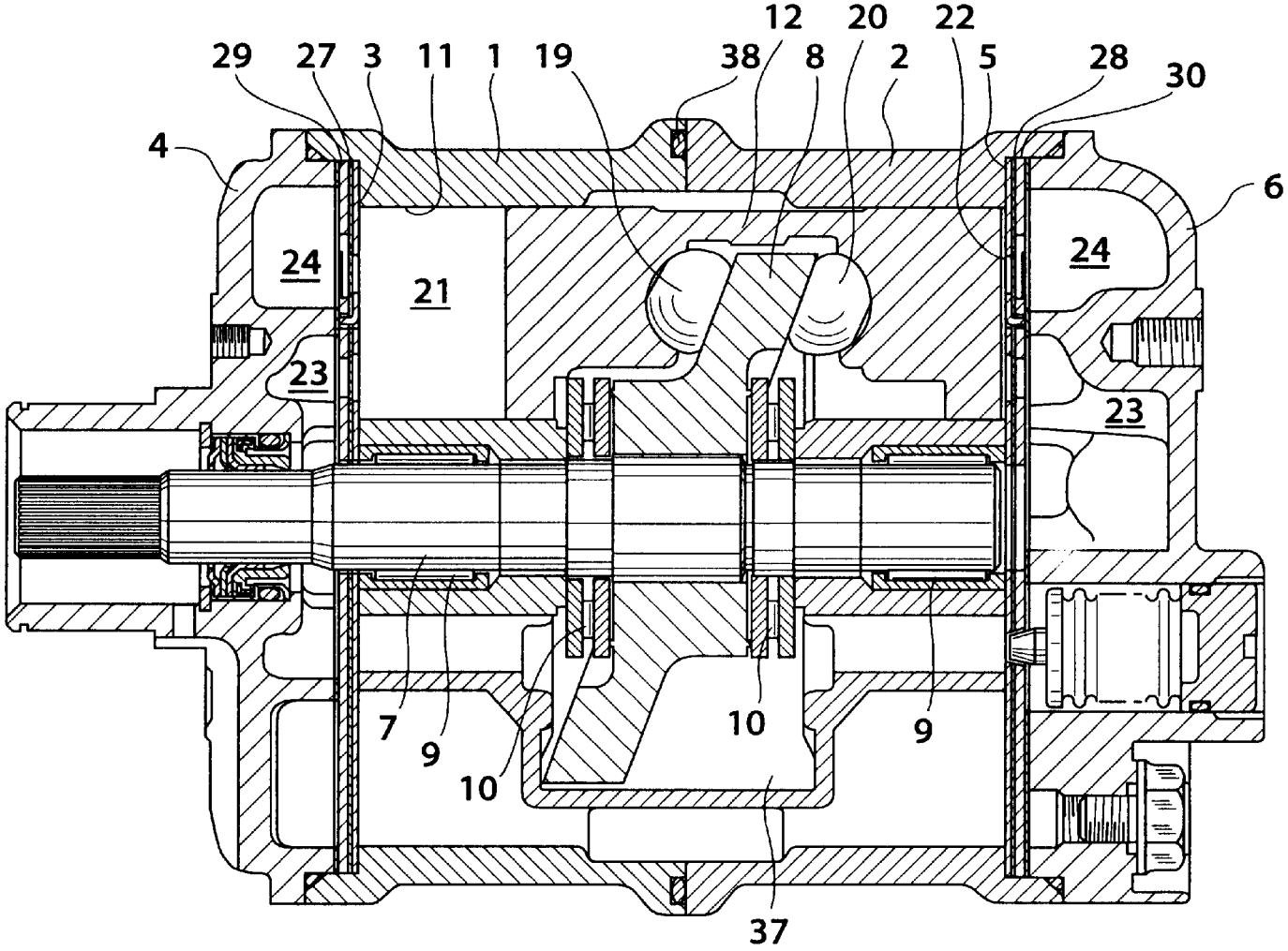
FIG. 5 is a longitudinal sectional view showing the whole arrangement of the swash plate compressor according to the first embodiment.

Referring first to FIG. 5, there is shown the whole arrangement of a swash plate compressor according to a first embodiment of the invention.

The compressor has a cylinder block 1 on a front side, and a cylinder block 2 on a rear side, with respective opposed ends joined to each other via an O ring 38 to form an assembly of the cylinder blocks 1, 2. The assembly of the cylinder blocks 1, 2 has one end thereof secured to a front head (cylinder head) 4 via a valve plate 3, a valve sheet 27, and a stopper plate 29, and the other end thereof secured to a rear head (cylinder head) 6 via a valve plate 5, a valve sheet 28, and a stopper plate 30.

A drive shaft 7 axially extends through the center of the assembly of the cylinder blocks 1, 2, and a swash plate 8 is rigidly fitted on the drive shaft 7. The drive shaft 7 and the swash plate 8 are rotatably supported in the assembly of the cylinder blocks 1, 2 via bearings 9, 10. The swash plate 8 is received within a swash plate chamber 37 defined within the assembly of the cylinder blocks 1, 2 at a joined portion thereof.

The assembly of the cylinder blocks 1, 2 has a plurality of cylinder bores 11 axially formed therethrough. The cylinder bores 11 are parallel to the axis of the drive shaft 7, and arranged at predetermined circumferential intervals about the drive shaft 7. Each cylinder bore 11 has a piston 12 slidably received therein. Within the cylinder bore 11, compression chambers 21, 22 are formed on opposite sides of the piston 12. The piston 12 is connected to the swash plate 8 via a pair of shoes 19, 20, each of which has a generally hemispherical shape, whereby the piston 12 reciprocates within the cylinder bore 11 as the swash plate 8 rotates.

Figure 1:
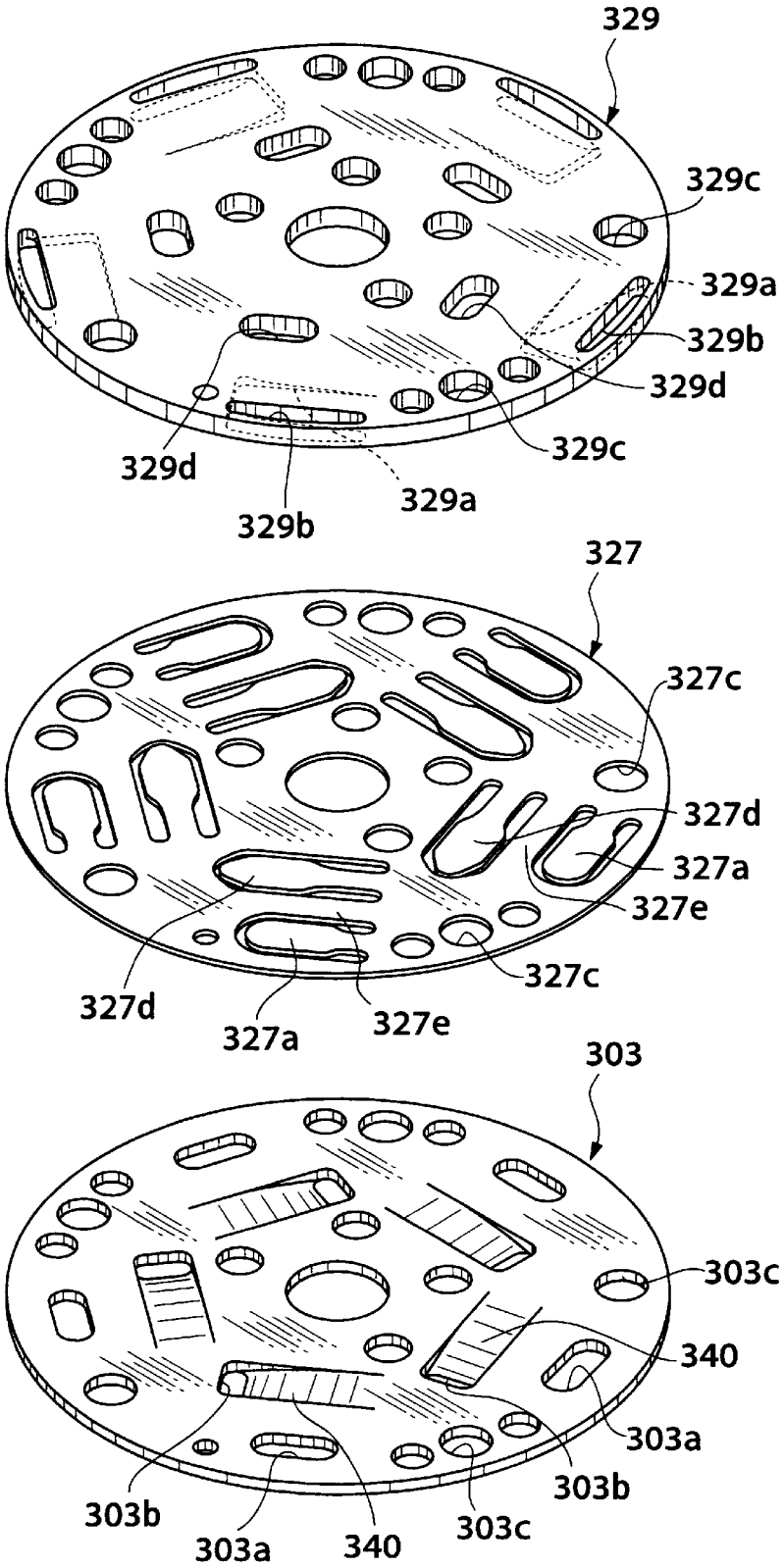
FIG.1 PRIOR ART
FIG. 1 is an exploded perspective view showing a valve plate, a valve sheet, a stopper plate of a conventional swash plate compressor.
Figure 2:
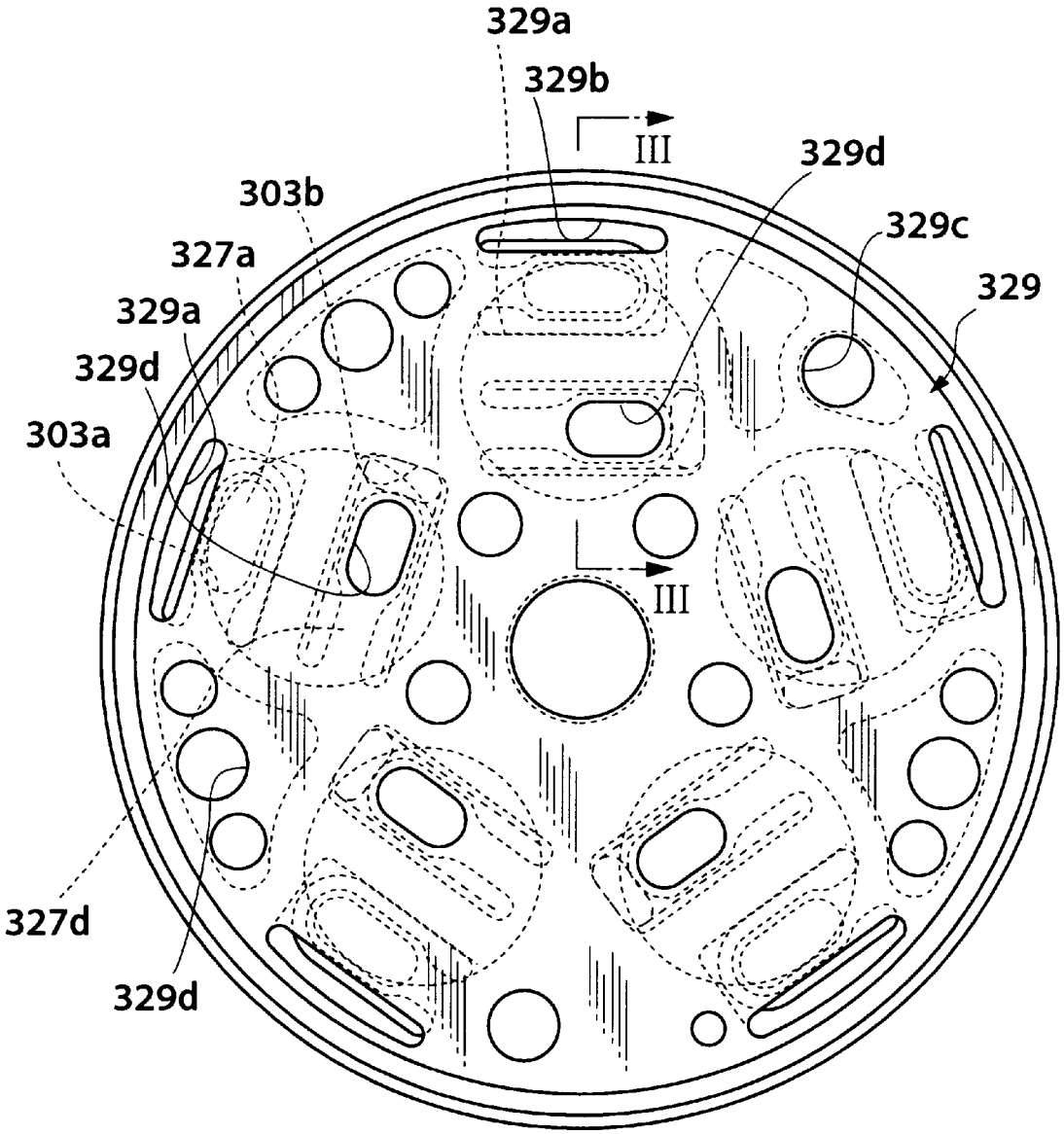
FIG.2 PRIOR ART
FIG. 2 is a plan view of the stopper plate of the conventional swash plate compressor in a state in which the valve plate, the valve sheet, and the stopper plate are assembled.
Figure 3:
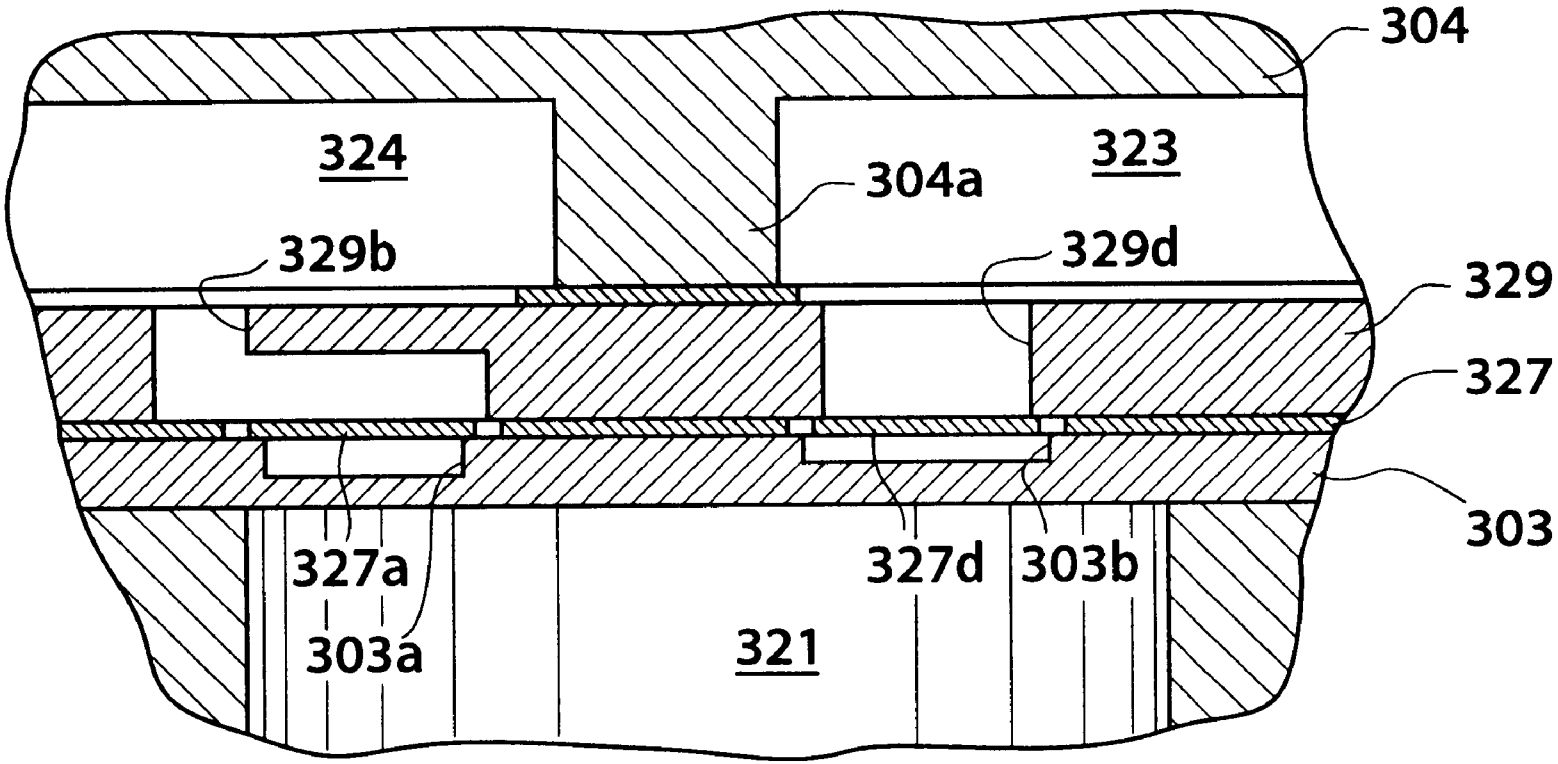
FIG.3 PRIOR ART
FIG. 3 is a partially sectional view taken on line III—III of FIG. 2.
Figure 4:
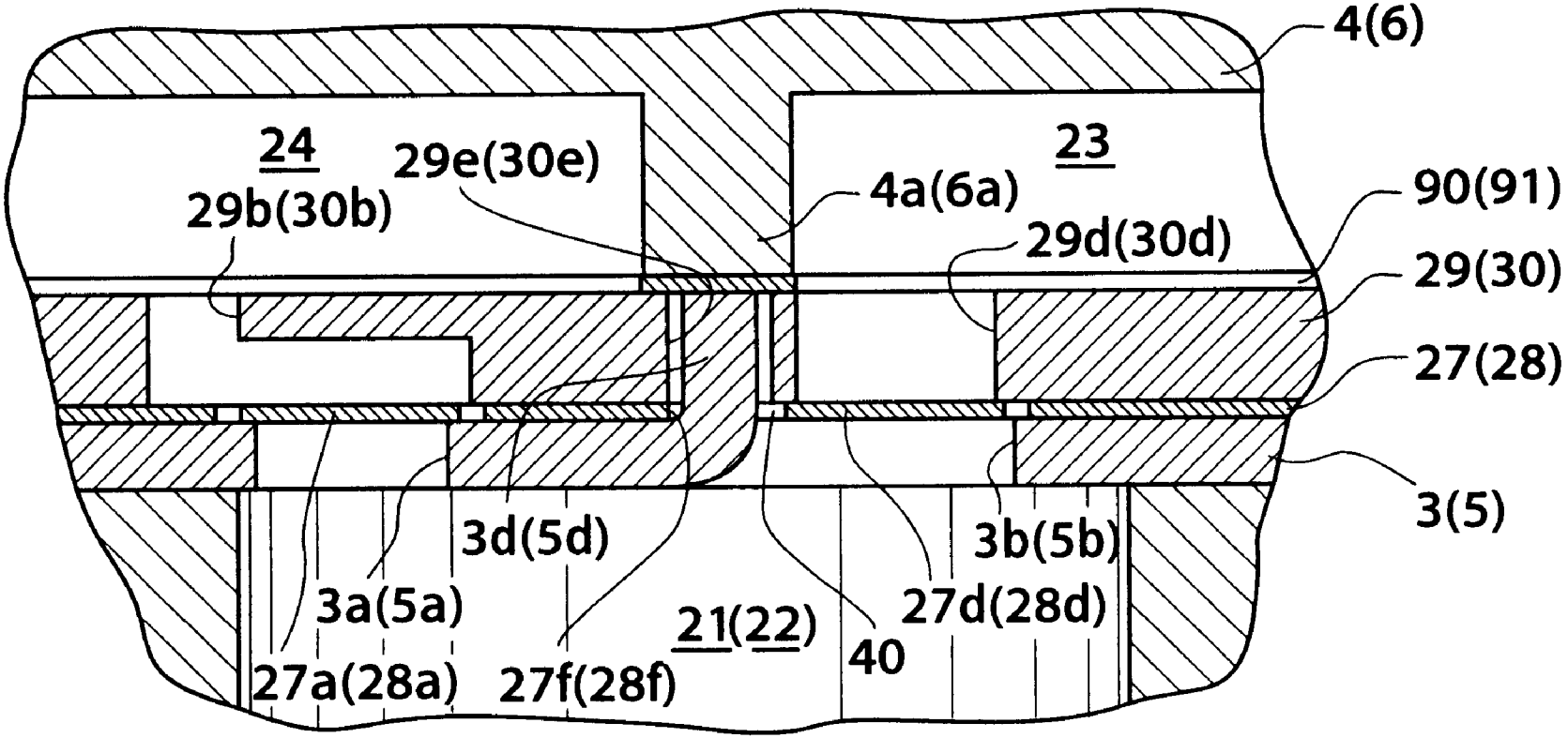
FIG. 4 is a partially sectional view showing essential parts of a swash plate compressor according to a first embodiment of the invention, taken on line IV—IV of FIG. 7.
Figure 6:
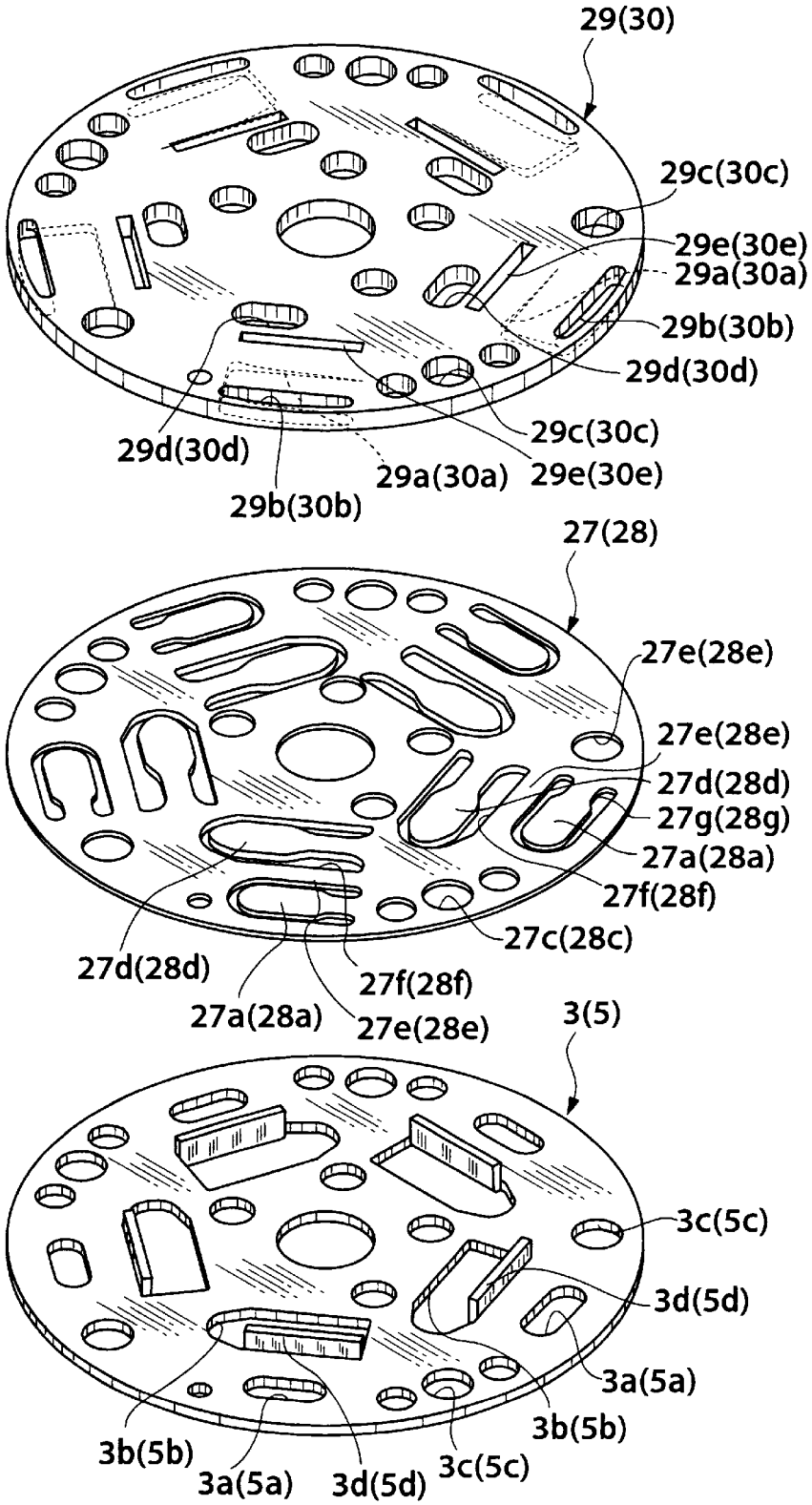
FIG. 6 is an exploded perspective view showing a valve plate, a valve sheet, and a stopper plate of the FIG. 5 swash plate compressor.
Figure 7:
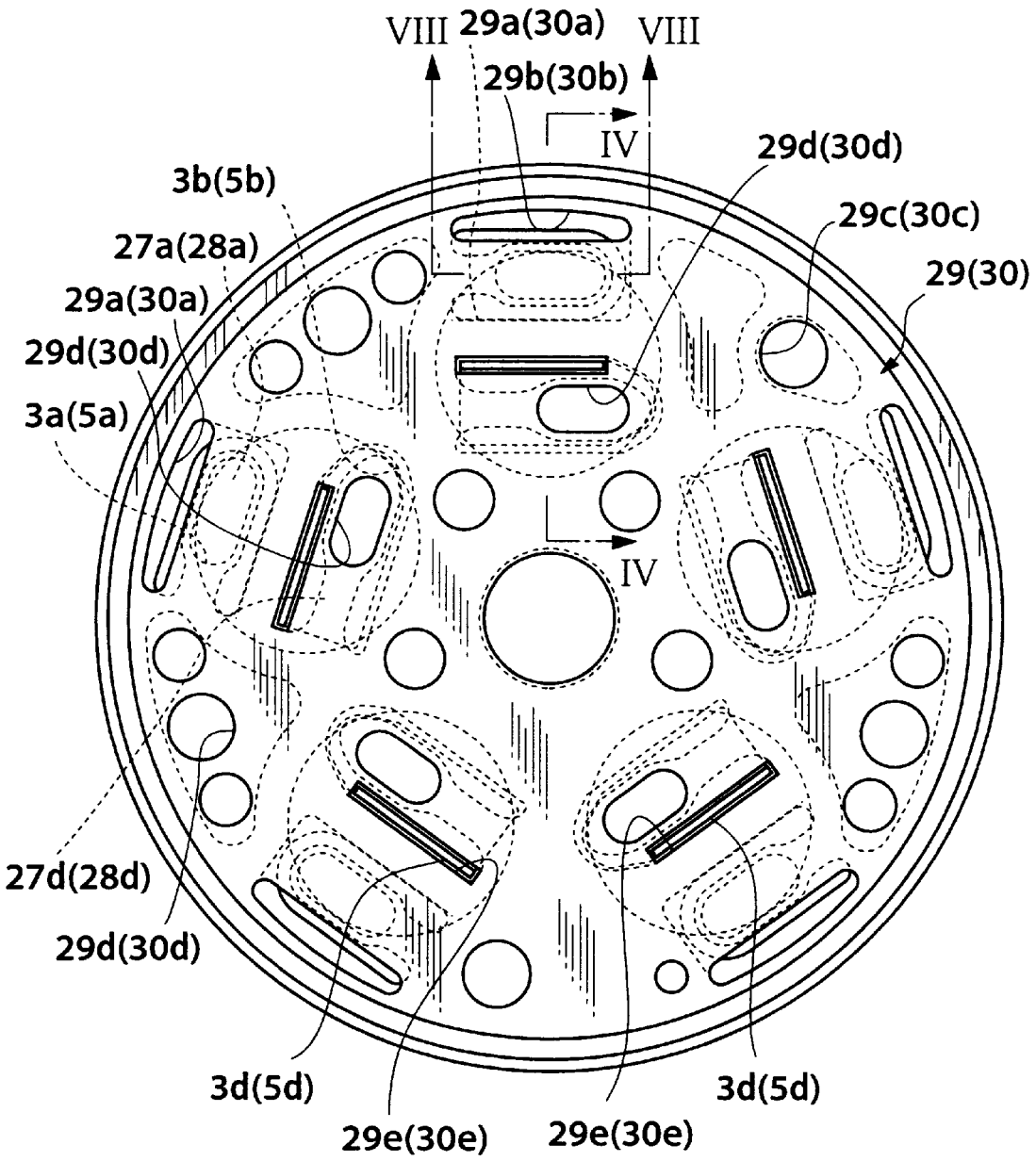
FIG. 7 is a plan view of the stopper plate of the FIG. 5 swash plate compressor in a state in which the valve plate, the valve sheet, and the stopper plate are assembled.
Figure 8:
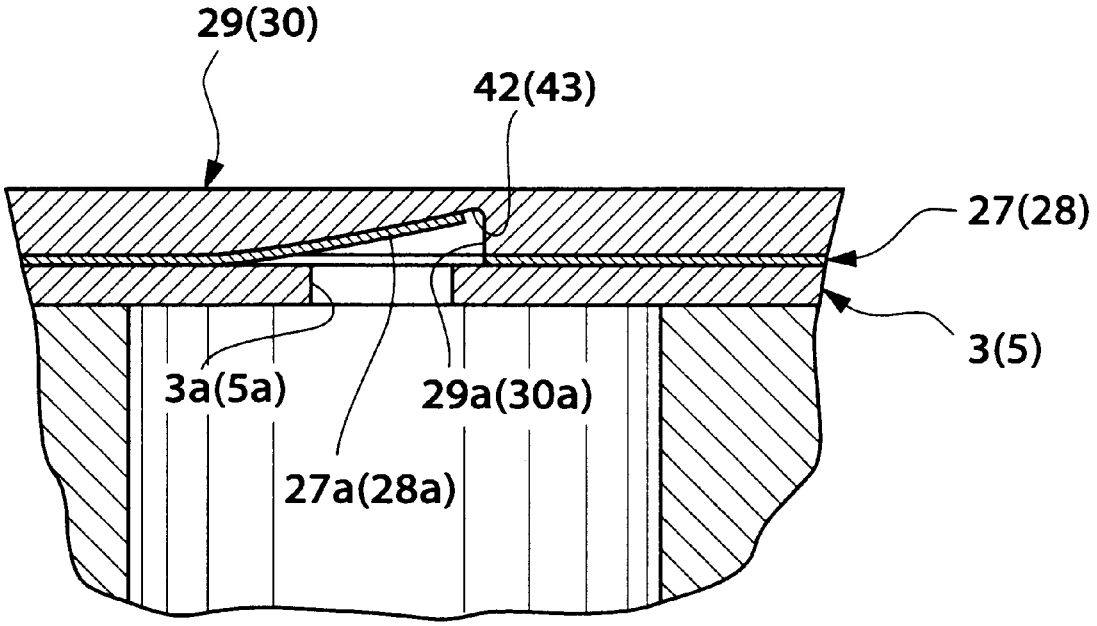
FIG. 8 is a partially sectional view taken on line VIII—VIII of FIG. 7.

FIG. 6 shows the valve plate, the valve sheet, and the stopper plate in an exploded state, while FIG. 7 is a plan view of the stopper plate in a state in which the valve plate, the valve sheet, and the stopper plate are assembled. FIG. 8 is a view taken on line VIII—VIII of FIG. 7. FIG. 4 is a view taken on line IV—IV of FIG. 7.

The valve plate 3(5), which is generally diskshaped, is formed therethrough with refrigerant outlet ports 3*a*(5*a*) via which refrigerant gas is delivered from the compression chambers 21(22) to a discharge chamber (high-pressure chamber) 24, relief holes 3*b*(5*b*) via each of which a suction valve element 27*d*(28*d*), referred to hereinbelow, opens toward a corresponding one of the compression chambers 21(22) during each suction stroke, and through holes 3*c*(5*c*) through which bolts, not shown, extend, respectively. The valve plate 3(5) is formed of a hot rolled steel (SPHC) or the like. Each of the relief holes 3*b*(5*b*) opens toward a corresponding one of the compression chambers 21(22), for communicating between the compression chamber 21(22) and a corresponding refrigerant inlet port 29*d*(30*d*), referred to hereinafter, when a corresponding suction valve element 27*d*(28*d*) opens.

Each of the relief holes 3*b*(5*b*) has a projecting portion 3*d*(5*d*) formed integrally with a portion of a rim of an opening thereof. As shown in FIG. 4, the projecting portion 3*d*(5*d*) is formed in a manner bent toward a partition wall 4*a*(6*a*) separating the discharge chamber 24 and a suction chamber (low-pressure chamber) 23 from each other. The bent or protruded projecting portion 3*d*(5*d*) is received within a space 40 (see FIG. 4) formed through the valve sheet 27(28) and the stopper plate 29(30). The space 40 is formed by a slot 27*f*(28*f*), referred to hereinbelow, formed through the valve sheet 27(28) and a slot 29*e*(30*e*), also referred to hereinafter, formed through the stopper plate 29(30). The slots 27*f*(28*f*) and 29*e*(30*e*) are formed through the valve sheet 27(28) and the stopper plate 29(30), respectively, in a manner opposed to each other in a direction of thickness of the valve plate 3(5) (i.e. in a horizontal direction as viewed in FIG. 4).

The valve sheet 27(28), which is generally disk-shaped, has a plurality of discharge valve elements 27*a*(28*a*) each cut into a tongue shape, i.e. defined by a slot 27*g*(28*g*), and the suction valve elements 27*d*(28*d*) each cut into a tongue shape, i.e. defined by the slot 27*f*(28*f*) and through holes 27*c*(28*c*) through which the bolts extend, respectively. The valve sheet 27(28) is formed e.g. of a leaf spring material. As shown in FIGS. 6 and 7, each of the discharge valve elements 27*a*(28*a*) and a corresponding one of the suction valve elements 27*d*(28*d*) are formed in a manner parallel to each other along length thereof with separating portion 27*e*(28*e*) formed therebetween.

The tongue-shaped suction valve members 27*d*(28*d*) and discharge valve elements 27*a*(28*a*) as well as the U-shaped slots 27*f*(28*f*) defining the suction valve elements 27*d*(28*d*) and the U-shaped slots 27*g*(28*g*) defining the discharge valve elements 27*a*(28*a*) are formed in one operation by punching the valve sheet 27(28). As shown in FIG. 6, a separating portion-side half of the U-shaped slot 27*f*(28*f*) has a larger width than a central valve sheet-side half of the same.

The stopper plate 29(30), which is generally disk-shaped, is formed with stopper portions 29*a*(30*a*). Each of the stopper portions 29*a*(30*a*) is formed by a recess opposed to a corresponding one of the tongue-shaped discharge valve elements 27*a*(28*a*). The stopper plate 29(30) is also formed with the refrigerant inlet ports 29*d*(30*d*) via which refrigerant gas is drawn from the suction chamber 23 into the compression chambers 21(22). The stopper plate 29(30) is formed of aluminum alloy, a hot rolled steel (SPHC) or the like. As shown in FIG. 8, each stopper portion 29*a*(30*a*) has a bottom surface which is inclined at a predetermined angle with respect to a corresponding one of the discharge valve elements 27*a*(28*a*) in a valve-closing position or sloped at a predetermined curvature, thereby setting a proper limit to an amount of opening or resilient deformation of the discharge valve element 27*a*(28*a*). FIG. 8 shows the discharge valve element 27*a*(28*a*) in a valve-opening position. The stopper plate 29(30) also has slots (refrigerant outlet passage) 29*b* (30*b*) formed therethrough along length of the stopper portions 29*a*(30*a*) in a manner continuous with the recesses defining the stopper portions 29*a*(30*a*), respectively. Each of the slots 29*b*(30*b*) is open to the discharge chamber 24 for communicating between a corresponding one of the refrigerant outlet ports 3*a*(5*a*) when a corresponding discharge valve element 27*a*(28*a*) opens. Further, the stopper plate 29(30) is formed therethrough with the slots 29*e*(30*e*) in each of which is received the projecting portions 3*d*(5*d*) formed on the valve plate 3(5). A gasket 90(91) is interposed between the stopper plate 29(30) and the head 4(6).

Each discharge valve element 27*a*(28*a*) is opposed to a corresponding one of the refrigerant outlet ports 3*a*(5*a*) formed through the valve plate 3(5) (see FIG. 8), and when the discharge valve element 27*a*(28*a*) opens, a corresponding one of the compression chambers 21(22) communicates with the discharge chamber 24 via the corresponding one of the refrigerant outlet ports 3*a*(5*a*) and a corresponding one of the slots 29*b*(30*b*) formed through the stopper plate 29(30).

On the other hand, each of the suction valve elements 27*d*(28*d*) is opposed to a corresponding one of the refrigerant inlet ports 29*d*(30*d*) formed through the stopper plate 29(30), and when the suction valve element 27*d*(28*d*) opens, one of the compression chambers 21(22) communicates with the suction chamber 23 via the corresponding one of the refrigerant inlet ports 29*d*(30*d*) and a corresponding one of the relief holes 3*b*(5*b*).

Next, the operation of the swash plate compressor according to the first embodiment will be described.

As the drive shaft 7 rotates, the swash plate 8 is rotated in unison therewith. According to the rotation of the swash plate 8, the piston 12 reciprocates within the cylinder bore 11. When the swash plate 8 rotates through 180 degrees after the piston 12 is at a position closest to the valve plate 3 (left-side extremity position in FIG. 5)(i.e. after the piston 12 is at its top dead center position within the compression chamber 21), the piston 12 slides to a position shown in FIG. 5 (right-side extremity position in FIG. 5), whereby the suction stroke is completed in the compression chamber 21, while the compression stroke is completed in the compression chamber 22. Thereafter, when the swash plate 8 further rotates through 180 degrees, the suction stroke is completed in the compression chamber 22, while the compression stroke is completed in the compression chamber 21.

During the suction stroke, the suction valve element 27*d*(28*d*) is resiliently deformed or bent toward a corresponding one of the relief holes 3*b*(5*b*), whereby a corresponding one of the refrigerant inlet ports 29*d*(30*d*) opens, and low-pressure refrigerant gas flows from the suction chamber 23 into the compression chamber 21(22) via the refrigerant inlet port 29*d*(30*d*) and the relief hole 3*b*(5*b*).

During the suction stroke, a force acting to deform the valve plate 3(5) toward the compression chamber 21(22) is produced by a difference in pressure between the discharge chamber 24 and the compression chamber 21(22). However, since the projecting portion 3*d*(5*d*) formed on the valve plate 3(5) in a manner protruding or bent toward the partition wall 4*a*(6*a*) secures high rigidity of the valve plate 3(5), deformation of the valve plate 3(5) is suppressed or inhibited, and hence high-pressure gas is prevented from flowing back from the discharge chamber 24 to the compression chamber 21(22).

On the other hand, during the compression stroke, the discharge valve element 27*a*(28*a*) is resiliently deformed or bent toward the discharge chamber 24, whereby high-pressure refrigerant gas is delivered from the compression chamber 21(22) to the discharge chamber 24. At this time point, the whole discharge valve element 27*a*(28*a*) abuts a bottom surface 42(43) of a corresponding one of the stopper portions 29*a*(30*a*), whereby the amount of opening or resilient deformation of the discharge valve element 27*a*(28*a*) is controlled.

According to the swash plate compressor of the first embodiment, it is possible to prevent a back flow of refrigerant gas from the discharge chamber 24 into the compression chamber 21(22) without increasing the thickness of the valve plate 3(5), so that an increase in dead volume within the compressor, which causes degradation of volumetric efficiency, can also be prevented.

Further, the valve plate 3(5) has a simple construction for enhancing rigidity thereof, which facilitates manufacturing of the plate 3(5). For instance, the projecting portions 3*d*(5*d*) of the valve, plate 3(5) can be formed by simply punching and pressing the valve plate 3(5).

Figure 9:
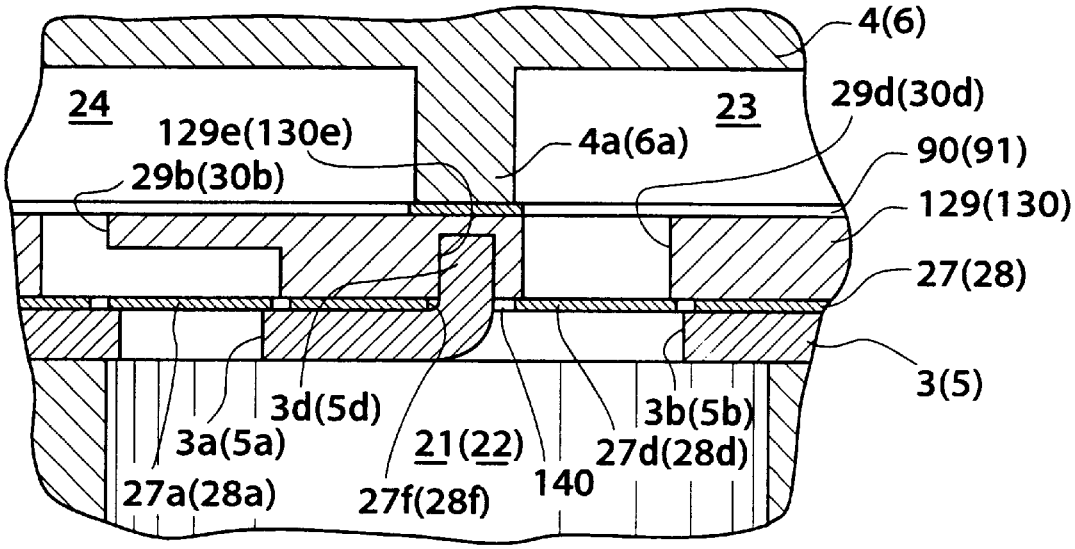
FIG. 9 is an enlarged sectional view showing essential parts of a swash plate compressor according to a second embodiment of the invention.

FIG. 9 shows essential parts of a swash plate compressor according to a second embodiment, on an enlarged scale. Component parts and elements corresponding to those of the first embodiment are indicated by identical reference numerals, and description thereof is omitted.

In the first embodiment, the space 40 is formed by the slots 27*f*(28*f*) formed through the valve sheet 27(28) and the slots 29*e*(30*e*) formed through the stopper plate 29(30), and the projecting portion 3*d*(5*d*) is received in the slots 27*f*(28*f*), 29*e*(30*e*) (i.e. in the space 40), while in the second embodiment, as shown in FIG. 9, a space 140 is formed by the slots 27*f*(28*f*) formed through the valve sheet 27(28) and a recess 129*e*(130*e*) each formed in a stopper plate 129(130) in a manner opposed to a corresponding one of the slots 27*f*(28*f*) in the direction of thickness of the valve plate 3(5), and the projecting portion 3*d*(5*d*) is fitted in the recess 129*e*(130*e*).

The second embodiment can provide the same effects as obtained by the first embodiment. Further, since the projecting portion 3*d*(5*d*) is fitted in the recess 129*e*(130*e*), the valve plate 3(5) is inhibited from moving in a radial direction (rightward and leftward as viewed in FIG. 9), whereby deformation of the valve plate 3(5) is further reliably prevented.

Further, the second embodiment is distinguished from the first embodiment in that the stopper plate 129(130) has no through hole or slot formed therethrough for forming the space 140. Therefore, it is possible to prevent high-pressure refrigerant gas from flowing into the suction chamber 23 from the compression chambers 21(22).

Figure 10:
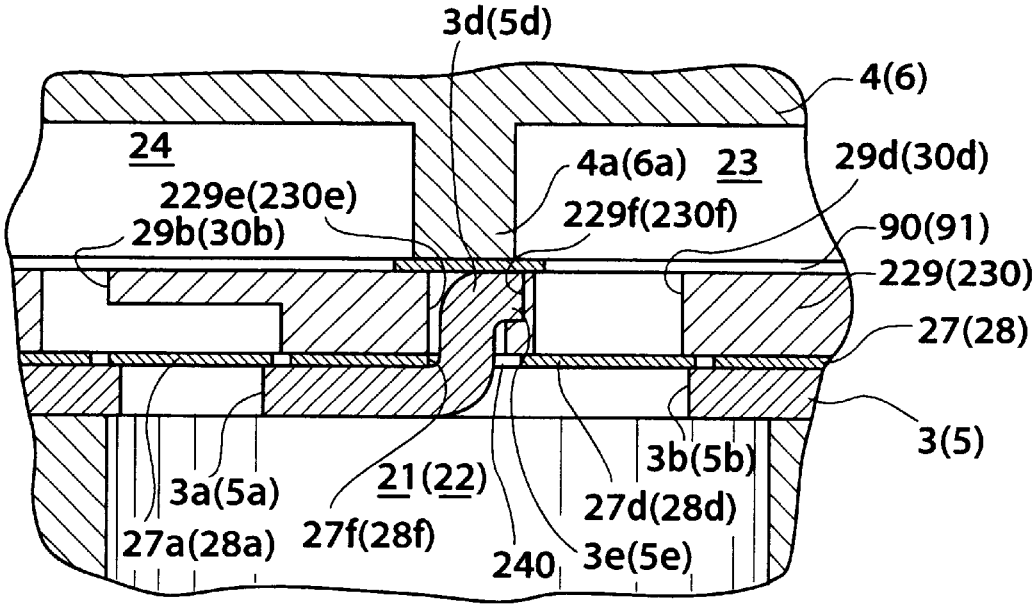
FIG. 10 is an enlarged sectional view showing essential parts of a swash plate compressor according to a third embodiment of the invention.

FIG. 10 shows essential parts of a swash plate compressor according to a third embodiment, on an enlarged scale. Component parts and elements corresponding to those of the first embodiment are indicated by identical reference numerals, and description thereof is omitted.

In the third embodiment, a space 240 is formed by the slot 27*f*(28*f*) formed through the valve sheet 27(28), a slot 229*e*(230*e*) formed through a stopper plate 229(230) in a manner opposed to a corresponding one of the slots 27*f*(28*f*) in the direction of thickness of the valve plate 3(5), and a recess 229*f*(230*f*) formed within the slot 229*e*(230*e*) by cutting away a portion of an inner peripheral wall of the slot 229*e*(230*e*).

The projecting portion of the valve plate 3(5) has an end 3*e*(5*e*) bent at a substantially right angle with respect to the direction of thickness of the valve plate 3(5) and fitted in the recess 229*f*(230*f*).

The third embodiment can provide the same effects as obtained by the first embodiment. Further, since the end 3*e*(5*e*) of the projecting portion 3*d*(5*d*) is fitted in the recess 229*e*(230*e*), the valve plate 3(5) is inhibited from moving in the direction of thickness of the valve plate 3(5) (i.e. upward and downward as viewed in FIG. 10), whereby deformation of the valve plate 3(5) is further reliably prevented.

Further, since the valve plate 3(5), the valve sheet 27(28), and the stopper plate 229(230) are joined to each other to form a unit, the components of the compressor including the valve plate 3(5) can be mounted in the compressor as the unit, which further facilitates assembly of the compressor in comparison with a conventional method in which the three components 3(5), 27(28), and 29(30) are mounted separately.

Figure 11:
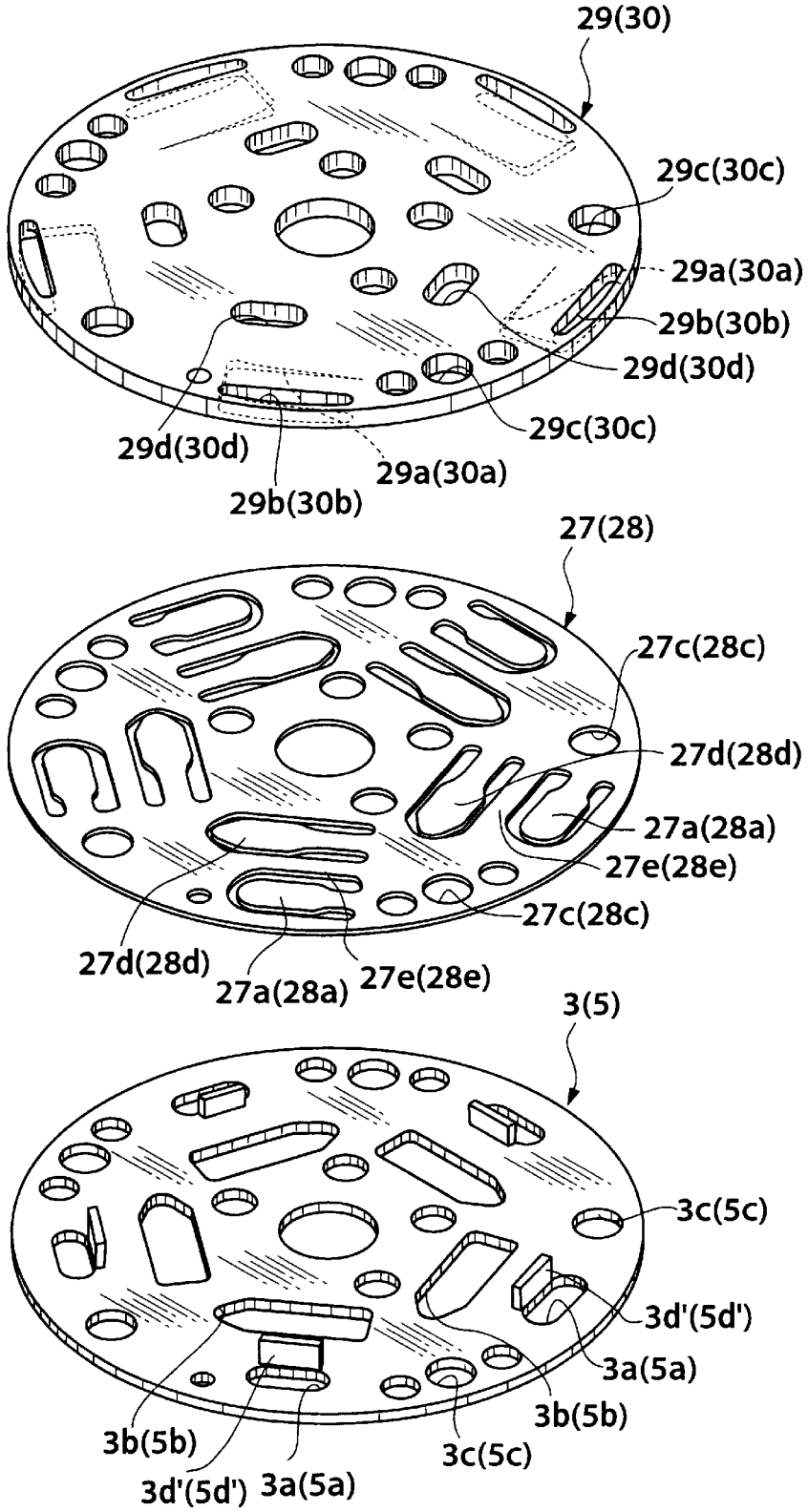
FIG. 11 is an enlarged sectional view showing essential parts of a swash plate compressor according to a fourth embodiment of the invention.

Although in the above embodiments, the projecting portion 3*d*(5*d*) is formed integrally with the portion of the rim of the opening of the relief hole 3*b*(5*b*), this is not limitative, but the projecting portion 3*d*'(5*d*') may be formed integrally with a portion of a rim of an opening of the refrigerant outlet port 3*a*(5*a*) according to a fourth embodiment of the invention, as shown in FIG. 11. Further, alternatively, the relief hole 3*b*(5*b*) and the refrigerant outlet port 3*a*(5*a*) may both have the projecting portions 3*d*(5*d*) and 3'(5*d*') formed integrally with the rims of openings thereof, respectively.

Further, although in the above embodiments, description is made of cases in which the present invention is applied to a swash plate compressor, this is not limitative, but the invention may be applied to other various types of reciprocating compressors, such as a wobble plate compressor and an in-line compressor (crank compressor).

It is further understood by those skilled in the art that the foregoing is the preferred embodiment of the invention, and that various changes and modification may be made without departing from the spirit and scope thereof.

What is claimed is:

1. In a reciprocating compressor including a cylinder block having a plurality of compression chambers formed therein, said compression chambers being formed on at least one of opposite ends of respective pistons slidably received within respective cylinder bores, a cylinder head secured to said cylinder block and having a high-pressure chamber and a low-pressure chamber formed therein, and a separating member arranged between said cylinder block and said cylinder head, said separating member having a plurality of refrigerant inlet ports for suctioning a refrigerant gas from said low-pressure chamber into said compression chambers, a plurality of refrigerant outlet ports for discharging said refrigerant gas from said compression chambers into said high-pressure chamber, a plurality of suction valves for opening and closing said refrigerant inlet ports, respectively, and a plurality of discharge valves for opening and closing said refrigerant outlet ports, respectively, the improvement wherein said separating member comprises:

a valve sheet formed with said suction valves and said discharge valves;

a valve plate arranged between said valve sheet and said cylinder block, and formed with said refrigerant outlet ports and a plurality of relief holes each opening into a corresponding one of said compression chambers, for communicating with a corresponding one of said refrigerant inlet ports when a corresponding one of said suction valves opens, said relief holes each having a projecting portion formed integrally with a portion of a rim of an opening thereof in a manner bent in a direction of thickness of said valve plate; and a stopper plate arranged between said valve sheet and said cylinder head and formed with said refrigerant inlet ports, a plurality of refrigerant outlet passages each opening into said high-pressure chamber for communication with a corresponding one of said refrigerant outlet ports when a corresponding one of said discharge valves opens, and a plurality of stoppers each setting a limit to an amount of opening of a corresponding one of said discharge valves.

2. A reciprocating compressor according to claim 1, wherein said projecting portion is bent toward a partition wall of said cylinder head that separates said high-pressure chamber and said low-pressure chamber from each other, and received in a through hole formed through said valve sheet and a space formed in said stopper plate in a manner continuing from said through hole.

3. A reciprocating compressor according to claim 2, wherein said space comprises a through hole formed through said stopper plate, and wherein said separating member further includes a gasket arranged between said stopper plate and said partition wall of said cylinder head for sealing said through hole of said stopper plate.

4. A reciprocating compressor according to claim 3, wherein said through hole of said stopper plate is defined by an inner peripheral wall formed with a recess, and wherein said projecting portion has an end thereof bent at a right angle with respect to said direction of thickness of said valve plate and fitted in said recess.

5. A reciprocating compressor according to claim 2, wherein said space comprises a recess formed in said stopper plate, and wherein said projecting portion has an end thereof fitted in said recess.

6. A reciprocating compressor according to claim 1, wherein said valve plate further includes a projecting portion formed integrally with a portion of a rim of an opening of each of said refrigerant outlet ports in a manner bent in said direction of thickness of said valve plate.

7. A reciprocating compressor according to claim 2, wherein said valve plate further includes a projecting portion formed integrally with a portion of a rim of an opening of each of said refrigerant outlet ports in a manner bent in said direction of thickness of said valve plate.

8. A reciprocating compressor according to claim 1, wherein said discharge valves each comprise a tongue shaped portion cut from said valve sheet, said suction valves each comprising a tongue shaped portion cut from said valve sheet, said stoppers each comprising a bottom of each of recesses formed in said stopper plate, said refrigerant outlet passages communicating with said recesses, respectively.

9. In a reciprocating compressor including a cylinder block having a plurality of compression chambers formed therein, said compression chambers being formed on at least one of opposite ends of respective pistons slidably received within respective cylinder bores, a cylinder head secured to said cylinder block and having a high-pressure chamber and a low-pressure chamber formed therein, and a separating member arranged between said cylinder block and said cylinder head, said separating member having a plurality of refrigerant inlet ports for suctioning a refrigerant gas from said low-pressure chamber into said compression chambers, a plurality of refrigerant outlet ports for discharging said refrigerant gas from said compression chambers into said high-pressure chamber, a plurality of suction valves for opening and closing said refrigerant inlet ports, respectively, and a plurality of discharge valves for opening and closing said refrigerant outlet ports, respectively, the improvement wherein said separating member comprises:

a valve sheet formed with said suction valves and said discharge valves;

a valve plate arranged between said valve sheet and said cylinder block, and formed with said refrigerant outlet ports and a plurality of relief holes each opening into a corresponding one of said compression chambers, for communicating with a corresponding one of said refrigerant inlet ports when a corresponding one of said suction valves opens, said refrigerant outlet ports each, having a projecting portion formed integrally with a portion of a rim of an opening thereof in a manner bent in a direction of thickness of said valve plate; and a stopper plate arranged between said valve sheet and said cylinder head and formed with said refrigerant inlet ports, a plurality of refrigerant outlet passages each opening into said high-pressure chamber, for communicating with a corresponding one of said refrigerant outlet ports when a corresponding one of said discharge, valves opens, and a plurality of stoppers each setting a limit to an amount of opening of a corresponding one of said discharge valves.

10. A reciprocating compressor according to claim 9, wherein said projecting portion is bent toward a partition wall of said cylinder head that separates said high-pressure chamber and said low-pressure chamber from each other, and received in a through hole formed through said valve sheet and a space formed in said stopper plate in a manner continuing from said through hole.

11. A reciprocating compressor according to claim 9, wherein said discharge valves each comprise a tongue shaped portion cut from said valve sheet, said suction valves each comprising a tongue shaped portion cut from said valve sheet, said stoppers comprising a bottom of each of grooves formed in said stopper plate, said refrigerant outlet passages communicating with said grooves, respectively.

* * * * *